US011145170B1

(12) United States Patent
Dryer

(10) Patent No.: US 11,145,170 B1
(45) Date of Patent: Oct. 12, 2021

(54) AUTOMATIC TELLER MACHINE WITH PRE-REGISTRATION

(71) Applicant: BANK OF AMERICA CORPORATION, Charlotte, NC (US)

(72) Inventor: Eric Dryer, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 0 days.

(21) Appl. No.: 16/884,162

(22) Filed: May 27, 2020

(51) Int. Cl.
*G07F 19/00* (2006.01)

(52) U.S. Cl.
CPC ..... *G07F 19/203* (2013.01); *G07F 19/208* (2013.01); *G07F 19/209* (2013.01)

(58) Field of Classification Search
CPC ..... G06Q 20/108; G06Q 20/1085; G06Q 20/322; G06Q 20/3221; G06Q 20/3223; G07F 19/00
See application file for complete search history.

(56) References Cited

U.S. PATENT DOCUMENTS 5,253,167 A 10/1993 Yoshida et al.
6,671,257 B1 12/2003 Soumiya et al.
7,040,533 B1 5/2006 Ramachandran
7,093,750 B1 8/2006 Block et al.
7,216,800 B1 5/2007 Ramachandran
7,230,223 B2 6/2007 Jespersen et al.
7,284,692 B1 10/2007 Douglass
7,392,938 B1 7/2008 Ramachandran
7,421,410 B1 9/2008 Schechtman et al.
7,458,507 B2 12/2008 Fillinger et al.
7,516,087 B1 4/2009 Meek et al.
7,533,804 B2 5/2009 Keohane et al.
7,559,461 B2 7/2009 Crowell et al.
7,584,885 B1 9/2009 Douglass
7,596,094 B2 9/2009 Puppa et al.
7,624,919 B2 12/2009 Meek et al.
7,627,525 B2 12/2009 Williams
7,783,571 B2 8/2010 Fish et al.
7,946,480 B2 5/2011 Miller et al.
7,992,777 B1 8/2011 Block et al.
8,078,518 B2 12/2011 Goertz et al.
8,169,906 B2 5/2012 Droz et al.
8,301,564 B2 10/2012 Mon et al.
8,301,565 B2 10/2012 Cantley et al.
8,401,023 B2 3/2013 Gallant et al.
8,561,891 B2 10/2013 Dent et al.
8,630,950 B2 1/2014 Saegert et al.
8,723,941 B1 5/2014 Shirbabadi et al.
9,558,636 B1 * 1/2017 Burdick ..... G07F 19/209
9,911,120 B2 3/2018 Laracey
9,922,370 B2 3/2018 Kobres et al.
(Continued)

*Primary Examiner* — Thien M Le
*Assistant Examiner* — April A Taylor
(74) *Attorney, Agent, or Firm* — Michael A. Springs

(57) ABSTRACT

An ATM pre-registration tool allows a user to request an amount of cash from an ATM before traveling to that ATM. The pre-registration tool receivers a user's request and determines whether a specified ATM contains the requested cash. If the ATM does not contain the requested cash, the pre-registration tool informs the user that the ATM does not contain sufficient funds to fulfill the user's request. If the ATM contains the requested cash, the pre-registration tool instructs the ATM to reserve that cash for the user.

17 Claims, 3 Drawing Sheets

(56) References Cited

U.S. PATENT DOCUMENTS

| | | | | |
|---|---|---|---|---|
| 10,290,052 | B1 | 5/2019 | Quesenberry et al. | |
| 10,353,689 | B2 | 7/2019 | Mishra et al. | |
| 10,395,199 | B1 | 8/2019 | Gibson et al. | |
| 10,825,307 | B1 * | 11/2020 | Bhuvad | G06Q 20/3221 |
| 11,037,115 | B2 * | 6/2021 | Benkreira | G06N 5/02 |
| 2004/0215566 | A1 | 10/2004 | Meurer | |
| 2007/0131757 | A1 | 6/2007 | Hamilton et al. | |
| 2010/0042541 | A1 | 2/2010 | Kang et al. | |
| 2013/0005253 | A1 | 1/2013 | Grigg et al. | |
| 2013/0339235 | A1 | 12/2013 | Tulluri et al. | |
| 2015/0363755 | A1 | 12/2015 | Walden et al. | |
| 2015/0379489 | A1 | 12/2015 | Gopalakrishnan et al. | |
| 2016/0086143 | A1 * | 3/2016 | Hao | G06Q 20/1085 705/43 |
| 2017/0221295 | A1 | 8/2017 | Pont et al. | |
| 2018/0130035 | A1 * | 5/2018 | Dhulipalla | H04W 4/02 |
| 2018/0285843 | A1 * | 10/2018 | Chaturvedi | G07F 19/203 |
| 2019/0034930 | A1 | 1/2019 | Wolfs et al. | |

* cited by examiner

AUTOMATIC TELLER MACHINE WITH PRE-REGISTRATION

TECHNICAL FIELD

This disclosure relates generally to automatic teller machines (ATMs).

BACKGROUND

Automatic teller machines are used to hold and dispense cash.

SUMMARY OF THE DISCLOSURE

Automatic teller machines (ATMs) are machines that hold and dispense cash. Users may approach an ATM and withdraw cash from the ATM or deposit cash into the ATM. The ATM updates an account of the user depending on the actions taken by the user. ATMs typically include a physical repository within the ATM that stores the cash. The ATMs track the amount of money in the repository and update that amount depending on the transactions that have occurred at the ATM.

When a user needs access to cash, the user may approach an ATM and attempt to withdraw cash. However, the user does not know how much cash is left in the ATM and the ATM does not know how much cash the user is going to request. As a result, if the user needs an amount of cash that exceeds the holdings of the ATM, the ATM denies the request and the user is left emptyhanded. When the ATM is located at a site that experiences higher crime rate, the user may be putting himself in peril merely to discover that the ATM does not contain the needed cash.

This disclosure contemplates an ATM pre-registration tool that allows a user to request an amount of cash from an ATM before traveling to that ATM. The pre-registration tool receivers a user's request and determines whether a specified ATM contains the requested cash. If the ATM does not contain the requested cash, the pre-registration tool informs the user that the ATM does not contain sufficient funds to fulfill the user's request. In response, the user does not expose himself to peril by traveling to the ATM. If the ATM contains the requested cash, the pre-registration tool instructs the ATM to reserve that cash for the user. In response, the user can travel to the ATM and quickly withdraw the reserved cash. As a result, the pre-registration tool provides several technical advantages. For example, the pre-registration tool improves the safety of the user by indicating to the user when a trip to the ATM is not going to be fruitful and by allowing the user to quickly withdraw reserved funds when at the ATM. Certain embodiments are described below.

According to an embodiment, an apparatus includes a memory and a hardware processor communicatively coupled to the memory. The hardware processor receives a request from a user to reserve an amount of cash at an automatic teller machine and in response to receiving the request, determines that the automatic teller machine contains at least the amount of cash. In response to determining that the automatic teller machine contains at least the amount of cash, the hardware processor communicates an instruction to the automatic teller machine to reserve the amount of cash for the user and to dispense the amount of cash to the user when an identifier for the user is presented to the automatic teller machine. The hardware processor also communicates the identifier to the user.

According to another embodiment, a method includes receiving, by a hardware processor communicatively coupled to a memory, a request from a user to reserve an amount of cash at an automatic teller machine and in response to receiving the request, determining, by the hardware processor, that the automatic teller machine contains at least the amount of cash. The method also includes in response to determining that the automatic teller machine contains at least the amount of cash, communicating, by the hardware processor, an instruction to the automatic teller machine to reserve the amount of cash for the user and to dispense the amount of cash to the user when an identifier for the user is presented to the automatic teller machine and communicating, by the hardware processor, the identifier to the user.

According to another embodiment, a system includes an automatic teller machine and a pre-registration tool that includes a hardware processor communicatively coupled to a memory. The hardware processor receives a request from a user to reserve an amount of cash at the automatic teller machine and in response to receiving the request, determines that the automatic teller machine contains at least the amount of cash. In response to determining that the automatic teller machine contains at least the amount of cash, the hardware processor communicates an instruction to the automatic teller machine to reserve the amount of cash for the user and to dispense the amount of cash to the user when an identifier for the user is presented to the automatic teller machine. The hardware processor also communicates the identifier to the user.

Certain embodiments provide one or more technical advantages. For example, an embodiment improves the safety of a user by informing the user when an ATM does not contain a requested amount of cash. As another example, an embodiment improves the safety of a user by allowing the user to quickly withdraw reserved funds from an ATM. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
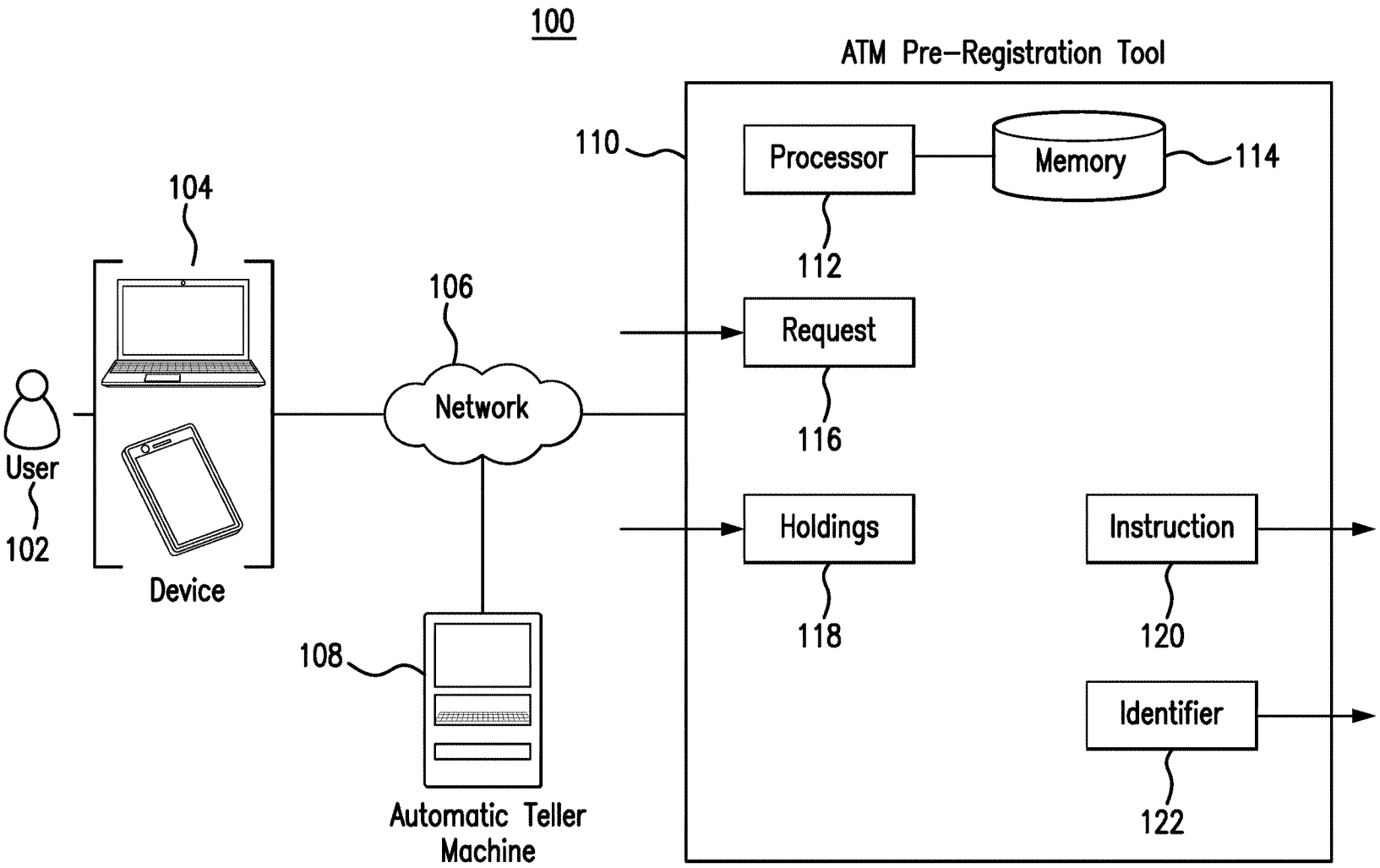
FIG. 1 illustrates an example system.
Figure 2:
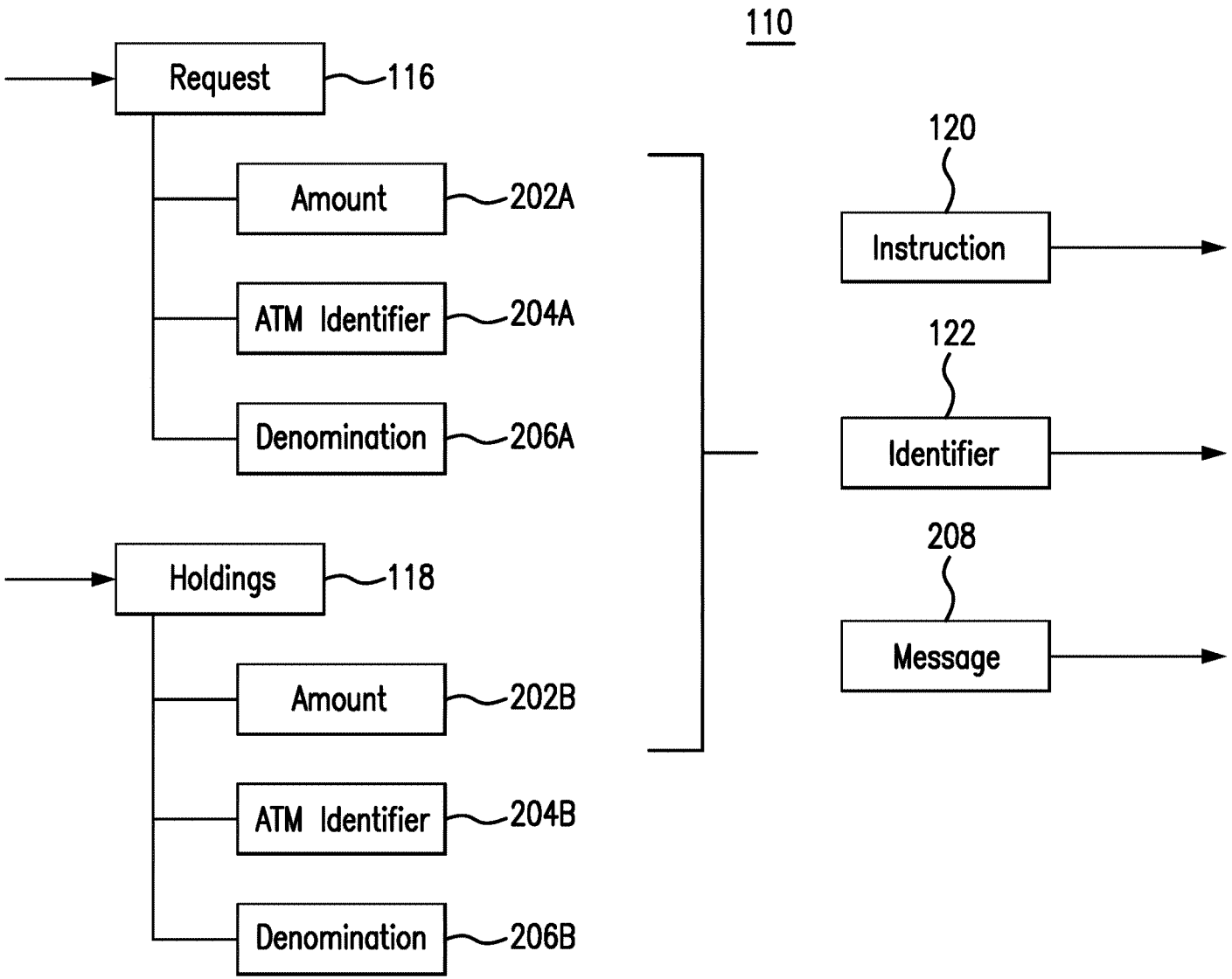
FIG. 2 illustrates an example ATM pre-registration tool of the system of FIG. 1.
Figure 3:
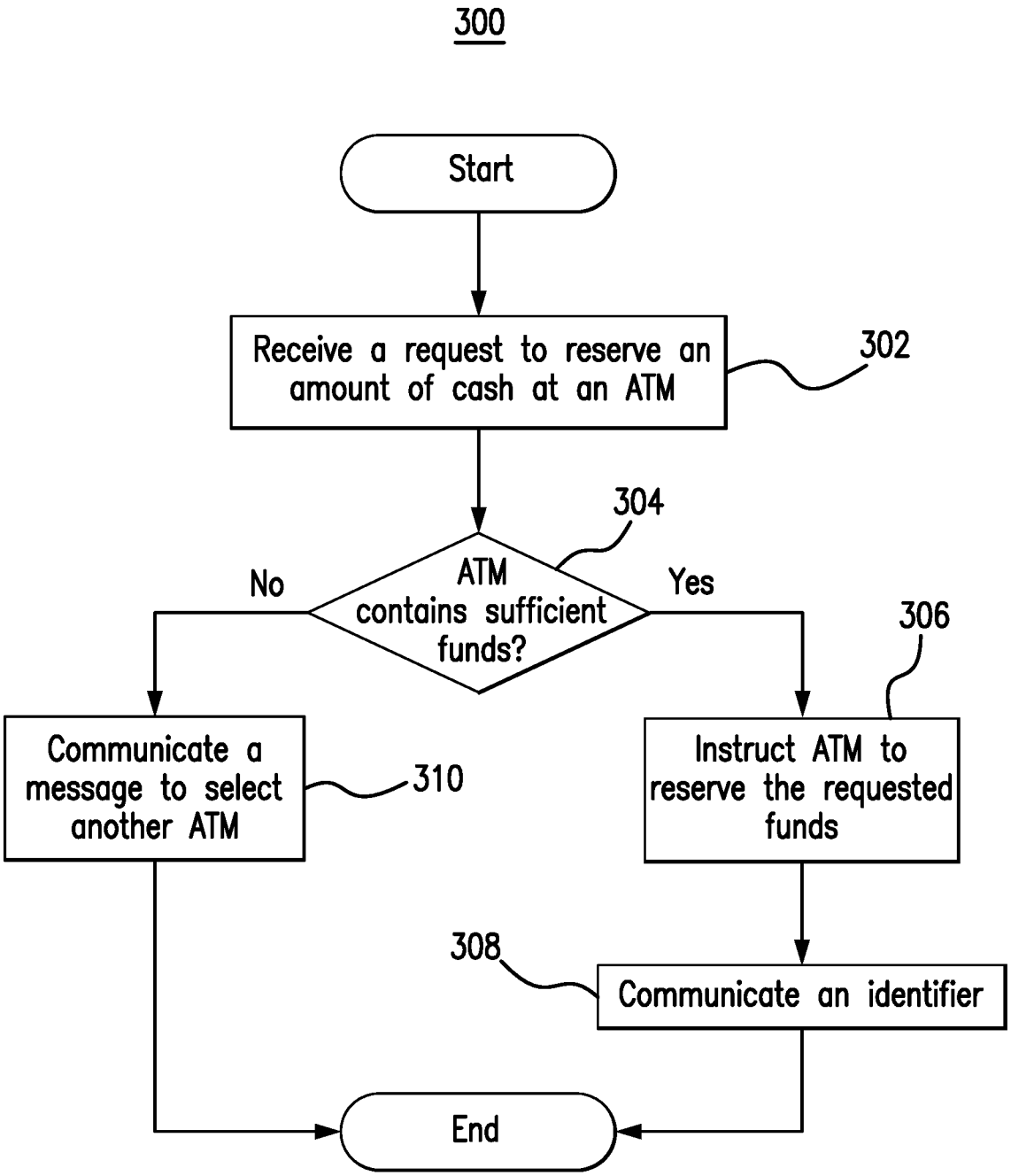
FIG. 3 is a flowchart illustrating a method for reserving funds using the system of FIG. 1.

Embodiments of the present disclosure and its advantages are best understood by referring to FIGS. 1 through 3 of the drawings, like numerals being used for like and corresponding parts of the various drawings.

Automatic teller machines (ATMs) are machines that hold and dispense cash. Users may approach an ATM and withdraw cash from the ATM or deposit cash into the ATM. The ATM updates an account of the user depending on the actions taken by the user. ATMs typically include a physical repository within the ATM that stores the cash. The ATMs track the amount of money in the repository and update that amount depending on the transactions that have occurred at the ATM.

When a user needs access to cash, the user may approach an ATM and attempt to withdraw cash. However, the user does not know how much cash is left in the ATM and the ATM does not know how much cash the user is going to request. As a result, if the user needs an amount of cash that exceeds the holdings of the ATM, the ATM denies the request and the user is left emptyhanded. When the ATM is located at a site that experiences higher crime rate, the user may be putting himself in peril merely to discover that the ATM does not contain the needed cash. Additionally, the user may spend even more time at the ATM performing conventional authentication and withdrawal procedures (e.g., presenting a physical card, entering a passcode, inputting a request for an amount of cash, waiting for processing, etc.), which further jeopardizes the user.

This disclosure contemplates an ATM pre-registration tool that allows a user to request an amount of cash from an ATM before traveling to that ATM. The pre-registration tool receivers a user's request and determines whether a specified ATM contains the requested cash. If the ATM does not contain the requested cash, the pre-registration tool informs the user that the ATM does not contain sufficient funds to fulfill the user's request. In response, the user does not expose himself to peril by traveling to the ATM. If the ATM contains the requested cash, the pre-registration tool instructs the ATM to reserve that cash for the user. In response, the user can travel to the ATM and quickly withdraw the reserved cash. As a result, the pre-registration tool provides several technical advantages. For example, the pre-registration tool improves the safety of the user by indicating to the user when a trip to the ATM is not going to be fruitful and by allowing the user to quickly withdraw reserved funds when at the ATM.

A practical application of the ATM pre-registration tool is that the ATM pre-registration tool improves the health and safety of a user by automatically determining whether an ATM contains a requested amount of funds, and if so, instructing the ATM to reserve those funds for the user. In this manner, the user need not expose himself to peril when the ATM does not contain the requested amount of funds, and the user can quickly withdraw reserved funds if the ATM does contain the requested funds. In both scenarios, the user's health and safety is improved, especially if the ATM is located in a high crime rate area. The system will be described in more detail using FIGS. 1 through 3.

FIG. 1 illustrates an example system 100. As seen in FIG. 1, system 100 includes one or more devices 104, a network 106, an automatic teller machine 108, and an ATM pre-registration tool 110. In particular embodiments, system 100 allows user 102 to reserve available funds at ATM 108, thereby improving the safety of user 102.

User 102 may use one or more devices 104 to communicate with other components of system 100. For example, user 102 may use device 104 to identify user 102 to ATM 108, such as by providing a quick response (QR) code or a radio frequency identifier (RFID). As another example, user 102 may use one or more devices 104 to communicate with ATM pre-registration tool 110 to reserve funds at ATM 108. Devices 104 include any appropriate device for communicating with components of system 100 over network 106. For example, devices 104 may be a telephone, a mobile phone, a computer, a laptop, a tablet, an automated assistant, and/or a cash register. This disclosure contemplates device 104 being any appropriate device for sending and receiving communications over network 106. As an example and not by way of limitation, device 104 may be a computer, a laptop, a wireless or cellular telephone, an electronic notebook, a personal digital assistant, a tablet, or any other device capable of receiving, processing, storing, and/or communicating information with other components of system 100. Device 104 may also include a user interface, such as a display, a microphone, keypad, or other appropriate terminal equipment usable by user 102. In some embodiments, an application executed by device 104 may perform the functions described herein.

Network 106 allows communication between and amongst the various components of system 100. For example, user 102 may use devices 104 to communicate over network 106. This disclosure contemplates network 106 being any suitable network operable to facilitate communication between the components of system 100. Network 106 may include any interconnecting system capable of transmitting audio, video, signals, data, messages, or any combination of the preceding. Network 106 may include all or a portion of a public switched telephone network (PSTN), a public or private data network, a local area network (LAN), a metropolitan area network (MAN), a wide area network (WAN), a local, regional, or global communication or computer network, such as the Internet, a wireline or wireless network, an enterprise intranet, or any other suitable communication link, including combinations thereof, operable to facilitate communication between the components.

Automatic teller machines 108 hold and dispense cash. A user may use ATMs 108 to deposit or withdraw cash from an account. ATMs 108 include any suitable number of interfaces through which the user interacts with the ATM 108, such as for example, buttons, keyboards, touchpads, touchscreens, speakers, microphones, cameras, etc. ATMs 108 may include a physical repository in which cash for the ATM 108 is stored. As cash 108 is deposited into or withdrawn from ATM 108, ATM 108 tracks and updates the amount of cash that ATM 108 believes it to be holding.

In a conventional system, when user 102 needs access to cash, user 102 approaches a physical ATM 108 and withdraws the cash. When ATM 108 does not contain enough cash to fulfill the user's 102 request, ATM 108 denies the request. If ATM 108 is located in a dangerous area, such as an area with a high crime rate, the user 102 would have traveled to ATM 108 and jeopardized his personal safety, only to have the request denied. It would have been safer for user 102 to have known beforehand that ATM 108 does not contain sufficient funds to fulfill the user's 102 request, so that user 102 does not jeopardize his safety by traveling to ATM 108.

ATM pre-registration tool 110 allows user 102 to instruct ATM 108 to reserve a requested amount of funds. If ATM 108 does not contain a sufficient amount of funds to fulfill the user's 102 request, the user 102 can be alerted before traveling to ATM 108. In this manner, the personal safety and security of user 102 is improved by ATM pre-registration tool 110 in particular embodiments. As seen in FIG. 1, ATM pre-registration tool 110 includes a processor 112 and a memory 114. This disclosure contemplates that processor 112 and memory 114 may be configured to perform any of the functions and actions of ATM pre-registration tool 110 discussed herein.

Processor 112 is any electronic circuitry, including, but not limited to microprocessors, application specific integrated circuits (ASIC), application specific instruction set processor (ASIP), and/or state machines, that communicatively couples to memory 114 and controls the operation of ATM pre-registration tool 110. Processor 112 may be 8-bit, 16-bit, 32-bit, 64-bit or of any other suitable architecture. Processor 112 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 112 may include other hardware that operates software to control and process information. Processor 112 executes software stored on memory to perform any of the functions described herein. Processor 112 controls the operation and administration of ATM pre-registration tool 110 by processing information received from devices 104, network 106, and memory 114. Processor 112 may be a programmable logic device, a microcontroller, a microprocessor, any suitable processing device, or any suitable combination of the preceding. Processor 112 is not limited to a single processing device and may encompass multiple processing devices.

Memory 114 may store, either permanently or temporarily, data, operational software, or other information for processor 112. Memory 114 may include any one or a combination of volatile or non-volatile local or remote devices suitable for storing information. For example, memory 114 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in memory 114, a disk, a CD, or a flash drive. In particular embodiments, the software may include an application executable by processor 112 to perform one or more of the functions described herein.

ATM pre-registration tool 110 receives a request 116 from user 102. User 102 may have communicated request 116 to ATM pre-registration tool 110 using one or more devices 104. Request 116 may indicate a desired amount of cash to be withdrawn from a particular ATM 108. ATM pre-registration tool 110 will analyze request 116 to determine whether the particular ATM 108 can then fulfill the request 116. Request 116 may be issued by device 104 in response to user 102 indicating that a certain amount of cash is desired from a particular ATM 108. Device 104 communicates request 116 to ATM pre-registration tool 110 to determine whether the ATM 108 can fulfill the request 116.

ATM pre-registration tool 110 receives holdings 118 from the ATM 108 indicated by request 116. Holdings 118 may indicate the amount of cash contained within ATM 108. ATM pre-registration tool 110 analyzes holdings 118 to determine whether the particular ATM 108 can fulfill request 116. ATM pre-registration tool 110 may receive holdings 118 in any suitable manner. For example, ATM pre-registration tool 110 may request and receive holdings 118 in response to receiving request 116. In this manner, ATM pre-registration tool 110 receives holdings 118 on an as-needed basis. As another example, ATM pre-registration tool 110 may receive holdings 118 from ATM 108 as an update when a transaction has occurred at ATM 108. In this manner, ATM pre-registration tool 110 knows the holdings 118 in ATM 108 in real-time. As yet another example, ATM pre-registration tool 110 may receive holdings 118 from ATM 108 periodically or according to a set frequency (e.g., once per hour).

If the ATM 108 can fulfill the request 116, ATM pre-registration tool 110 communicates an instruction 120 to the ATM 108. Instruction 120 may instruct ATM 108 to reserve or hold an amount of cash indicated by request 116 for user 102. In response to instruction 120, ATM 108 holds or reserves an amount of cash for user 102. In other words, if another user approaches ATM 108, that other user would not be able to withdraw funds from the reserved funds in ATM 108. If ATM 108 does not contain a sufficient amount of funds to fulfill request 116, ATM pre-registration tool 110 may communicate a message to user 102 to inform user 102 that ATM 108 does not contain a sufficient amount of funds and that user 102 should select another ATM 108.

If ATM 108 contains a sufficient amount of funds to fulfill request 116, ATM pre-registration tool 110 generates and communicates an identifier 122 to device 104. User 102 may present identifier 122 on device 104 to ATM 108 to complete the requested withdrawal of cash. Identifier 122 may be any suitable identifier of device 104/user 102. For example, identifier 122 may be a QR code, a radio frequency identifier, a picture or image, etc. User 102 may hold device 104 up to a scanner, reader, antenna, etc. of ATM 108 to present identifier 122 to ATM 108 in certain embodiments. ATM 108 may then read identifier 122 and determine that user 102 is present at ATM 108. ATM 108 may then dispense the reserved amount of funds to user 102. In this manner, user 102 knows that ATM 108 contains a sufficient amount of funds before user 102 travels to ATM 108. Additionally, user 102 is able to quickly withdraw funds from ATM 108 without engaging in the typical authentication and withdrawal process, which may include presenting a physical card, entering a passcode or pin, and/or responding to prompts. As a result, the personal safety and security of user 102 is improved by ATM pre-registration tool 110.

FIG. 2 illustrates an example ATM pre-registration tool 110 of the system 100 of FIG. 1. As discussed previously, ATM pre-registration tool 110 improves the safety of a user 102 by allowing the user 102 to determine whether a particular ATM 108 contains a requested amount of funds before the user 102 travels to the ATM 108. Additionally, ATM pre-registration tool 110 allows the user 102 to quickly withdraw a requested amount of funds from the ATM 108, which reduces the amount of time the user 102 spends at the ATM and further improves the personal health and safety of the user 102, in certain embodiments.

ATM pre-registration tool 110 receives a request 116 from user 102 and/or device 104. As seen in FIG. 2, request 116 indicates an amount 202A and an ATM identifier 204A. Amount 202A may indicate an amount of cash requested to be withdrawn by user 102. ATM identifier 204A may identify a particular ATM 108 from which the user 102 desires to withdraw the amount 202A. ATM pre-registration tool 110 then determines whether ATM 108 contains sufficient funds to fulfill the amount 202A requested in request 116.

In particular embodiments, request 116 includes a denomination 206A. Denomination 206A may indicate the denominations by which the requested amount 202A is to be fulfilled. For example, if user 102 is requesting to withdraw $100, denomination 206A may indicate that the requested $100 should be fulfilled with four $20 bills, a $10 bill, a $5 bill and five $1 bills. ATM pre-registration tool 110 may determine whether the ATM 108 identified by ATM identifier 204A contains the requested amount 202A in the requested denomination 206A.

ATM pre-registration tool 110 receives holdings 118 from one or more ATMs 108. Holdings 118 generally indicate the amount of funds contained by an ATM 108. As seen in FIG.

2, holdings 118 indicates an amount 202B and an ATM identifier 204B. Amount 202B indicates the amount of cash contained within an ATM 108. ATM identifier 204B identifies the ATM 108. Thus, based on holdings 118, ATM pre-registration tool 110 determines an amount 202B of cash contained within an ATM 108 identified by ATM identifier 204B. In certain embodiments, holdings 118 further indicates the denomination 206B. Denomination 206B may indicate a quantity of different types of bills held by ATM 108.

ATM pre-registration tool 110 may receive holdings 118 in any suitable manner. For example, ATM pre-registration tool 110 may receive holdings 118 from one or more ATMs 108 periodically to update the information within ATM pre-registration tool 110. ATMs 108 may communicate holdings 118 to update ATM pre-registration tool 110 when a transaction has been performed by the ATM 108. In some embodiments, ATM pre-registration tool 110 may request and receive holdings 118 in response to receiving a request 116. In this manner, ATM pre-registration tool 110 retrieves holdings 118 for a particular ATM 108 when a transaction is requested with that ATM 108 by the user 102.

In response to receiving request 116, ATM pre-registration tool 110 determines whether the ATM 108 identified by ATM identifier 204A contains the requested amount 202A. ATM pre-registration tool 110 may retrieve and/or analyze holdings 118 with an ATM identifier 204B that matches ATM identifier 204A. ATM pre-registration tool 110 then compares amount 202B with amount 202A. If amount 202B exceeds amount 202A, then ATM pre-registration tool 110 may determine that the ATM 108 contains a sufficient amount of funds to fulfill request 116. If amount 202B does not exceed amount 202A, ATM pre-registration tool 110 may determine that ATM 108 cannot fulfill request 116. In particular embodiments ATM pre-registration tool 110 may also analyze the denomination 206B to determine whether the ATM contains sufficient quantities of bills to fulfill the requested denomination 206A in request 116. If denomination 206B does not include a sufficient quantity of one or more bills requested in denomination 206A, then ATM pre-registration tool 110 may determine that ATM 108 cannot fulfill request 116. If denomination 206B indicates that ATM 108 contains a sufficient quantity of bills requested by denomination 206A, then ATM pre-registration tool 110 may determine that ATM 108 can fulfill request of 116.

If ATM pre-registration tool 110 determines that the ATM 108 can fulfill request 116, ATM pre-registration tool 110 generates and communicates instructions 120 to ATM 108. Instruction 120 may instruct the ATM 108 to reserve amount 202A for user 102. In certain embodiments, instruction 120 may further instruct ATM 108 to reserve amount 202A in the requested denomination 206A for user 102. In response to receiving instruction 120, ATM 108 reserves amount 202A for user 102. In other words, if another user were to request an amount of funds from ATM 108 before user 102 arrives at ATM 108, ATM 108 would not fulfill the other user's request if that request would require dispensing funds from the reserved amount (e.g., if ATM 108 contains less than the other user's requested amount excluding the reserved funds). As another example, if user 102 were to communicate a subsequent request 116 to withdraw another amount of funds from ATM 108, ATM pre-registration tool 110 would determine that the ATM 108 could not fulfill the subsequent request if the subsequent requested amount of funds would require the ATM 108 dispense funds from the reserved amount (e.g., if ATM 108 contains less than the subsequent requested amount excluding the reserved funds).

If ATM pre-registration tool 110 determines that the ATM 108 can fulfill request 116, ATM pre-registration tool 110 generates and communicates identifier 122 to user 102 and device 104. Identifier 122 may be any suitable identifier that identifies user 102 and/or device 104. For example, an identifier 122 may be a QR code or a radio frequency identifier. User 102 may present identifier 122 to ATM 108, and in response ATM 108 dispenses the reserve amount of cash to user 102. User 102 may present identifier 122 in any suitable manner. For example, user 122 may present identifier 122 by presenting device 104 to a reader, scanner or antenna of ATM 108. ATM 108 may then read identifier 122 from device 104. For example, if identifier 122 is a QR code, ATM 108 may use a reader or scanner to scan the QR code from a display device 104. As another example, if identifier 122 is a radio frequency identifier, ATM 108 may use an antenna to receive the radio frequency identifier from device 104.

If ATM 108 cannot fulfill request 116, ATM pre-registration tool 110 may generate and communicate a message 208 to device 104. Message 208 may indicate to user 102 that ATM 108 cannot fulfill that request 116. In certain embodiments, message 208 further recommends another ATM 108 that can fulfill request 116. User 102 can then select the other ATM 108 to reserve the requested amount 202A at the other ATM 108. In some embodiments, message 208 may ask user 102 whether it is acceptable for ATM 108 to fulfill request 116 using a denomination 206 other than that requested by user 112. For example, if ATM 108 cannot fulfill request 116 using the denomination 206 requested by user 102, then message 208 may ask if user 102 will accept a different type of denomination 206 available in ATM 108. If user 102 accepts, then ATM pre-registration tool 110 may instruct ATM 108 to fulfill request 116 using the available denomination 206.

FIG. 3 is a flow chart illustrating the method 300 for reserving funds at an ATM 108. Generally, ATM pre-registration tool 110 performs method 300. In particular embodiments by performing method 300, ATM pre-registration tool 110 improves the personal safety and health of a user 102.

ATM pre-registration tool 110 begins by receiving a request 116 to reserve an amount 202A of cash at an ATM 108 in step 302. In step 304, ATM pre-registration tool 110 determines whether the ATM 108 contains a sufficient amount 202B of funds to fulfill the request 116. In come embodiments ATM pre-registration tool 110 may also determine whether the ATM 108 contains a sufficient quantity of different types of bills to fulfill a requested denomination 206A. ATM pre-registration tool 110 may make these determinations based on holdings 118 received from ATM 108.

If ATM pre-registration tool 110 determines that the ATM 108 can fulfill the request 116, ATM pre-registration tool 110 instructs the ATM 108 to reserve the requested funds in step 306 by communicating an instruction 120 to the ATM 108. In response, the ATM 108 holds or reserves the requested funds for the user 102. In step 308, ATM pre-registration tool 110 communicates an identifier 122 to the user 102 or device 104. The identifier 122 may identify user 102 or device 104. User 102 may present the identifier 122 to the ATM 108. In response, the ATM 108 dispenses the reserved funds to the user 102. If ATM pre-registration tool 110 determines that the ATM cannot fulfill request 116, ATM pre-registration tool 110 communicates a message 208 to user 102. The message 208 may indicate that the ATM 108 cannot fulfill the request 116. In certain embodiments, the message 208 recommends another ATM 108 that can fulfill request 116. User 102 may select the recommended ATM 108 to fulfill the request 116 and in response, the other ATM 108 reserves the requested amount of funds for user 102.

Modifications, additions, or omissions may be made to method 300 depicted in FIG. 3. Method 300 may include more, fewer, or other steps. For example, steps may be performed in parallel or in any suitable order. While discussed as ATM pre-registration tool 110 performing the steps, any suitable component of system 100, such as device(s) 104 for example, may perform one or more steps of the methods.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a memory; and a hardware processor communicatively coupled to the memory, the hardware processor configured to:

receive a first request from a user to reserve a first amount of cash at an automatic teller machine, the first request identifying the automatic teller machine;

in response to receiving the first request, determine that the automatic teller machine contains at least the first amount of cash;

in response to determining that the automatic teller machine contains at least the first amount of cash, communicate an instruction to the automatic teller machine to reserve the first amount of cash for the user and to dispense the first amount of cash to the user when an identifier is presented to the automatic teller machine, wherein the identifier identifies both the user and an electronic device of the user;

communicate the identifier to the user;

receive a second request to reserve a second amount of cash at the automatic teller machine, wherein the second request indicates a first denomination for the second amount of cash;

determine that the automatic teller machine does not contain at least the second amount of cash in the first denomination; and solicit input from a sender of the second request indicating whether the automatic teller machine is permitted to fulfill the second request with a second denomination of the second amount of cash that is different from the first denomination, wherein the second denomination of the second amount of cash is available at the automatic teller machine.

2. The apparatus of claim 1, wherein:

the first request indicates a denomination for the first amount of cash;

the hardware processor is further configured to determine that the automatic teller machine contains at least the first amount of cash in the denomination;

the instruction is communicated further in response to the determination that the automatic teller machine contains at least the first amount of cash in the denomination; and the instruction further instructs the automatic teller machine to reserve the first amount of cash for the user in the denomination.

3. The apparatus of claim 1, wherein the hardware processor is further configured to:

receive a second request from the user to reserve a second amount of cash at the automatic teller machine;

in response to receiving the second request, determine that the automatic teller machine does not contain at least the second amount of cash; and in response to determining that the automatic teller machine does not contain at least the second amount of cash, communicate a message to the user recommending another automatic teller machine that has been identified as capable of fulfilling the second request.

4. The apparatus of claim 1, wherein the identifier is presented to the automatic teller machine through radio frequency identification.

5. The apparatus of claim 1, wherein, before the user presents the identifier to the automatic teller machine, the automatic teller machine is configured to deny a separate request that would cause the automatic teller machine to contain less than the first amount of cash.

6. The apparatus of claim 1, wherein the automatic teller machine is configured to dispense to the user the reserved amount of cash after the user presents the identifier to the automatic teller machine.

7. A method comprising:

receiving, by a hardware processor communicatively coupled to a memory, a request from a user to reserve a first amount of cash at an automatic teller machine, the first request identifying the automatic teller machine;

in response to receiving the request, determining, by the hardware processor, that the automatic teller machine contains at least the first amount of cash;

in response to determining that the automatic teller machine contains at least the first amount of cash, communicating, by the hardware processor, an instruction to the automatic teller machine to reserve the first amount of cash for the user and to dispense the first amount of cash to the user when an identifier is presented to the automatic teller machine, wherein the identifier identifies both the user and an electronic device of the user;

communicating, by the hardware processor, the identifier to the user;

receiving a second request to reserve a second amount of cash at the automatic teller machine, wherein the second request indicates a first denomination for the second amount of cash;

determining that the automatic teller machine does not contain at least the second amount of cash in the first denomination; and soliciting input from a sender of the second request indicating whether the automatic teller machine is permitted to fulfill the second request with a second denomination of the second amount of cash that is different from the first denomination, wherein the second denomination of the second amount of cash is available at the automatic teller machine.

8. The method of claim 7, further comprising determining, by the hardware processor, that the automatic teller machine contains at least the first amount of cash in a denomination, the first request indicates the denomination for the first amount of cash, the instruction is communicated further in response to the determination that the automatic teller machine contains at least the first amount of cash in the denomination, the instruction further instructs the automatic teller machine to reserve the first amount of cash for the user in the denomination.

9. The method of claim 7, further comprising:

receiving, by the hardware processor, a second request from the user to reserve a second amount of cash at the automatic teller machine;

in response to receiving the second request, determining, by the hardware processor, that the automatic teller machine does not contain at least the second amount of cash; and in response to determining that the automatic teller machine does not contain at least the second amount of cash, communicating, by the hardware processor, a message to the user recommending another automatic teller machine that has been identified as capable of fulfilling the second request.

10. The method of claim 7, wherein the identifier is presented to the automatic teller machine through radio frequency identification.

11. The method of claim 7, wherein, before the user presents the identifier to the automatic teller machine, the automatic teller machine is configured to deny a separate request that would cause the automatic teller machine to contain less than the first amount of cash.

12. The method of claim 7, wherein the automatic teller machine is configured to dispense to the user the reserved amount of cash after the user presents the identifier to the automatic teller machine.

13. A system comprising:

an automatic teller machine; and a pre-registration tool comprising a hardware processor communicatively coupled to a memory, the hardware processor configured to:

receive a first request from a user to reserve a first amount of cash at the automatic teller machine, the first request identifying the automatic teller machine;

in response to receiving the first request, determine that the automatic teller machine contains at least the first amount of cash;

in response to determining that the automatic teller machine contains at least the first amount of cash, communicate an instruction to the automatic teller machine to reserve the first amount of cash for the user and to dispense the first amount of cash to the user when an identifier is presented to the automatic teller machine, wherein the identifier identifies both the user and an electronic device of the user;

communicate the identifier to the user;

receive a second request to reserve a second amount of cash at the automatic teller machine, wherein the second request indicates a first denomination for the second amount of cash;

determine that the automatic teller machine does not contain at least the second amount of cash in the first denomination; and solicit input from a sender of the second request indicating whether the automatic teller machine is permitted to fulfill the second request with a second denomination of the second amount of cash that is different from the first denomination, wherein the second denomination of the second amount of cash is available at the automatic teller machine.

14. The system of claim 13, wherein:

the first request indicates a denomination for the first amount of cash;

the hardware processor is further configured to determine that the automatic teller machine contains at least the first amount of cash in the denomination;

the instruction is communicated further in response to the determination that the automatic teller machine contains at least the first amount of cash in the denomination; and the instruction further instructs the automatic teller machine to reserve the first amount of cash for the user in the denomination.

15. The system of claim 13, wherein the hardware processor is further configured to:

receive a second request from the user to reserve a second amount of cash at the automatic teller machine;

in response to receiving the second request, determine that the automatic teller machine does not contain at least the second amount of cash; and in response to determining that the automatic teller machine does not contain at least the second amount of cash, communicate a message to the user recommending another automatic teller machine that has been identified as capable of fulfilling the second request.

16. The system of claim 13, wherein the identifier is presented to the automatic teller machine through radio frequency identification.

17. The system of claim 13, wherein, before the user presents the identifier to the automatic teller machine, the automatic teller machine is configured to deny a separate request that would cause the automatic teller machine to contain less than the first amount of cash.

* * * * *